US006010322A

United States Patent [19]

Lai

[11] Patent Number: 6,010,322

[45] Date of Patent: Jan. 4, 2000

[54] ROTATIONAL POWER GENERATING DEVICE

[76] Inventor: Jui H. Lai, No. 171, Sec. 2, Bin Hai Road, Su Ao, I-Lan Hsien, Taiwan

[21] Appl. No.: 08/947,635

[22] Filed: Oct. 9, 1997

[51] Int. Cl.[7] ..... F01C 1/344; F01C 21/10

[52] U.S. Cl. ..... 418/255

[58] Field of Search ..... 418/255

[56] References Cited

U.S. PATENT DOCUMENTS 3,213,803 10/1965 Meyer ..... 418/255

4,451,220 5/1984 Ito et al. ..... 418/255

*Primary Examiner*—John J. Vrablik

*Attorney, Agent, or Firm*—Bacon & Thomas, PLLC

[57] ABSTRACT

A high compression ratio and mechanical efficiency are realized by a rotary power generating device having a cylindrical ring secured between a pair of cylindrical casings. A rotor assembly is disposed within the internal chamber defined by the ring and casings and includes a pair of shafts which extend outwardly through eccentric holes formed in the casings. The assembly further includes a pair of collars engaged within arcuate-shaped recesses formed in the internal walls of the casings and a longitudinal slot through which a blade is slidably received to define three closed areas within the internal chamber.

1 Claim, 3 Drawing Sheets

ROTATIONAL POWER GENERATING DEVICE

FIELD OF THE INVENTION

The present invention relates to a rotational power-generating device that can be applied in an engine, a compressor, and a motor.

DESCRIPTION OF PRIOR ART

The conventional reciprocal engine has a great inertia loss during the transformation of movement, i.e. from linear movement into rotational movement. This will bring an unbalance to the engine. Besides, the work is transformed from the linkage to the crankshaft. Since the work is branched, the performance is lowered. Furthermore, the conventional reciprocal engine has a complicated configuration that renders a great number of malfunctions. As a result, the application is limited. The conventional reciprocal engine has a high fuel consumption as well as pollution. This is really not environment friendly.

SUMMARY OF THE INVENTION

It is the objective of this invention to provide a rotational power-generating device by which the problems of the conventional reciprocal engine can be suitably solved.

BRIEF DESCRIPTION OF DRAWINGS

In order that the present invention may more readily be understood the following description is given, merely by way of example with reference to the accompanying drawings, in which.

DETAILED DESCRIPTION OF PREFERRED EMBODIMENT

Figure 1:
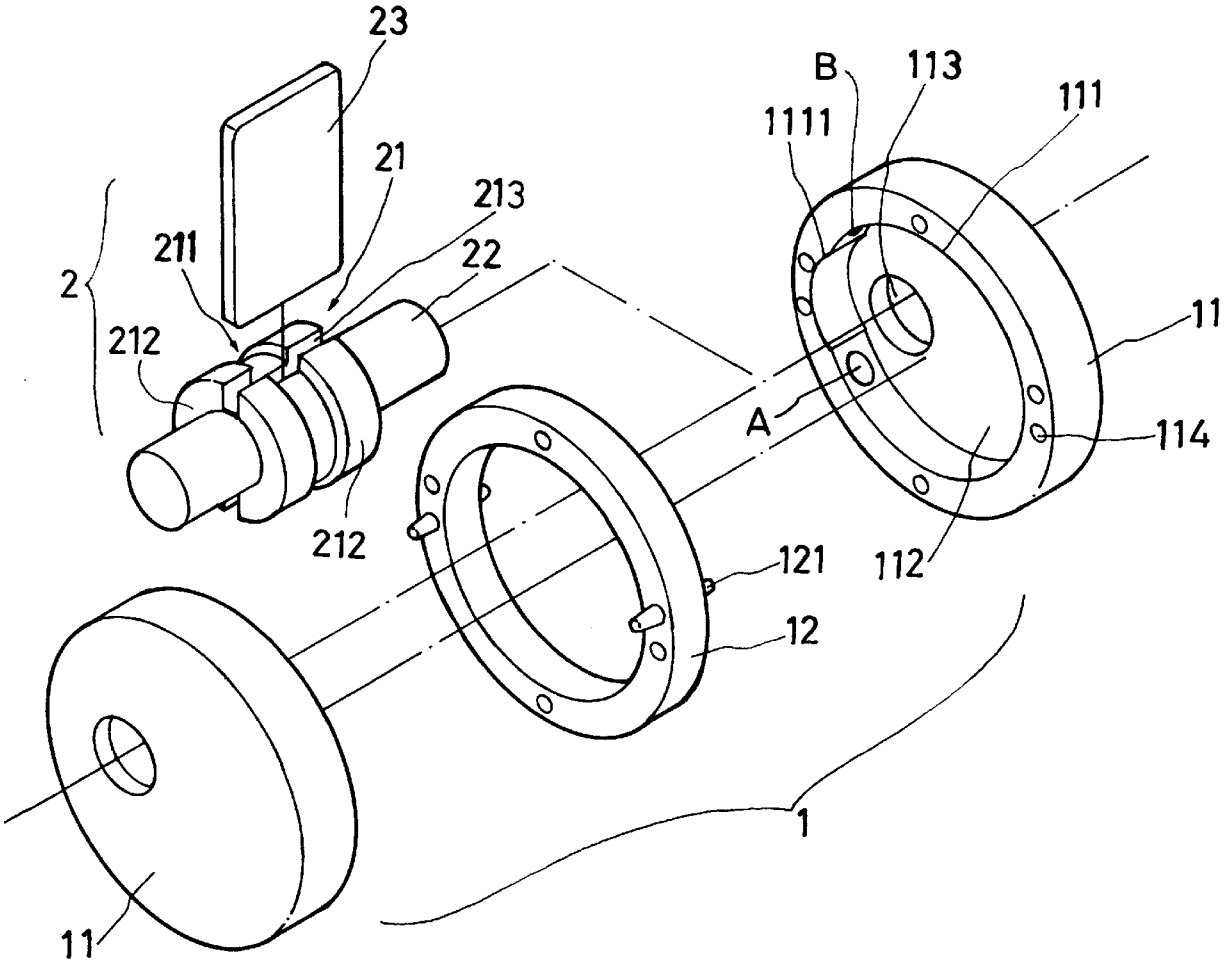
FIG. 1 is an exploded perspective view of the rotational power-generating device.

Referring to FIG. 1, the cylinder block 1 is configured by a pair of cylinder casings 11 and a cylinder ring 12 that is sandwiched between the cylinder casings 11. Each cylinder casing 11 is provided with an inlet port A and outlet port B, and a plurality of retaining holes 114 for receiving retaining pins therein. Each of the cylinder casings 11 is further provided with a cylinder wall 111 which is formed by machining and has a curved contour. The contour of the cylinder wall 11 forms a perimeter that is defined by the maximum length of the blade 23 which rotates and centers on the center of the rotor assembly 2 and a circle which is plotted by the blade 23 that rotates and centers on the center point of the cylinder casing 11. The cylinder casing 11 further has a circular sidewall 112 that forms a vertical wall portion of the cylinder wall 111. The cylinder sidewall 112 is further provided with an eccentric mounting hole 113 through which the rotational shaft 22 is rotationally disposed. The mounting hole 113 is offset from the center point of the cylinder casing 11, and a recessed arcuate inner wall section 1111 is formed in the internal cylinder wall 111 and in which the rotor 2 is rotatably received. This wall section 1111 is used to provide a space for the smooth rotation of the blade 23 and without interference with the cylinder wall 111. By this arrangement, the collar 212 of the rotor 21 serves as a bearing within the wall section 1111. Furthermore, a high-pressure zone is formed. Furthermore, the circular front walls defining the mating faces of the cylinder casings 11 and the cylinder ring 12 are provided with a plurality of retaining holes 114 and retaining pins 121 that are aligned with each other.

The cylinder ring 12 is sized to engage the two cylinder casings 11. However, the cylinder ring 12 is not provided with a recessed arcuate wall section. Accordingly, the inner perimeter of the cylinder ring 12 completely corresponds with the above mentioned curved contour of cylinder walls 111. By this arrangement, the blade 23 of the rotor assembly 2 may smoothly rotate. The cylinder ring 12 is provided with a plurality of retaining pins 121 that are aligned with and correspond to retaining holes 114. By the provision of the retaining holes 114 and retaining pins 121, those cylinder casings 11 and cylinder ring 12 may engaged together. Pins 121 extend from opposed circular faces of ring 12.

The rotor assembly 2 is configured by a rotor 21, a pair of rotational shafts 22 disposed at both sides of the rotor 21, and a blade 23. The rotor 21 has a cylindrical configuration and is provided with a neck portion 211 that is corresponds to the size of the cylinder ring 12. The rotor 21 is further provided with a pair of collars 212 that are disposed at both sides of the neck portion 211. The collars 212 are sized such that they can be disposed within the wall section 1111. The rotor 21 is further provided with a receiving slot 213 that extends longitudinally through the collars 212 and the neck portion 211. The blade 23 has a rectangular shape and may be inserted and retained within the retaining slot 213 for slidable movement therein.

Figure 2:
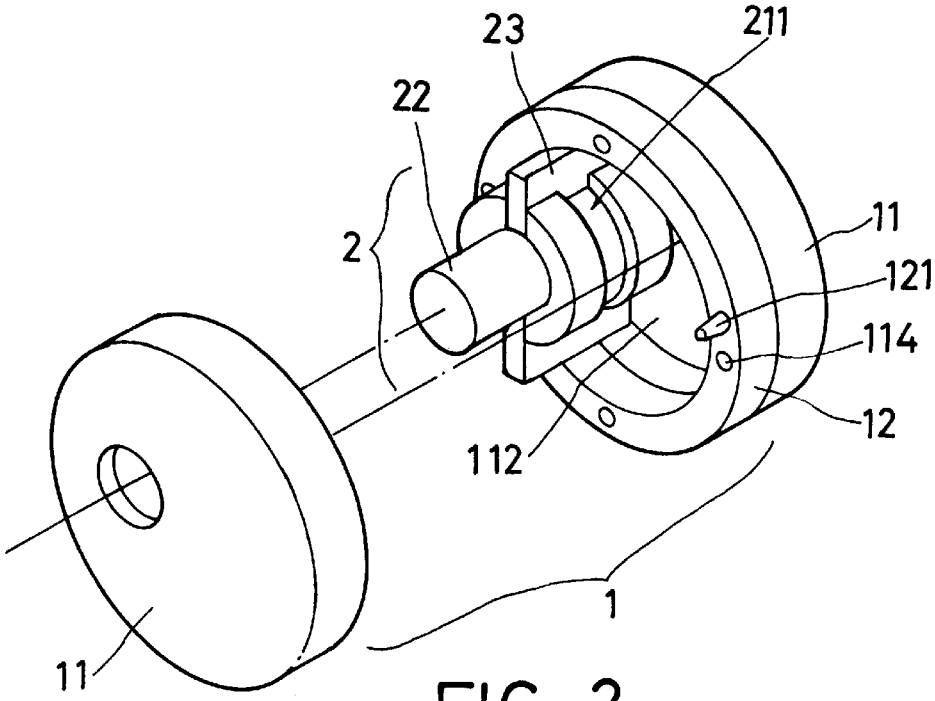
FIG. 2 is a perspective view of the rotational power generating device shown in FIG. 1.
Figure 3:
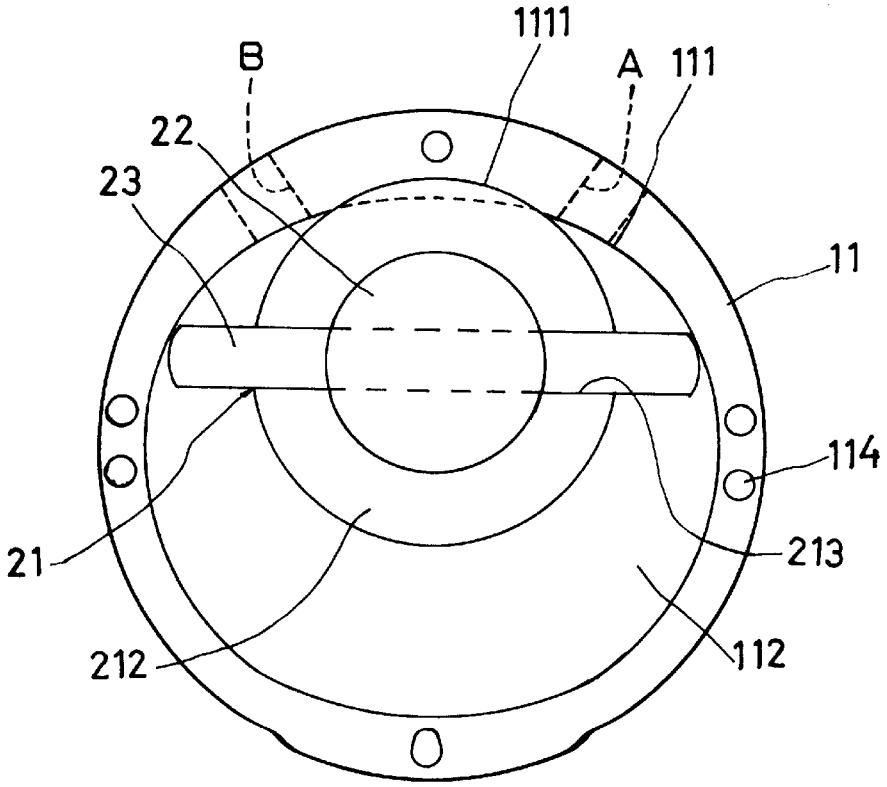
FIG. 3 is a schematic illustration showing the partitioning chambers in the rotational power-generating device.
Figure 4:
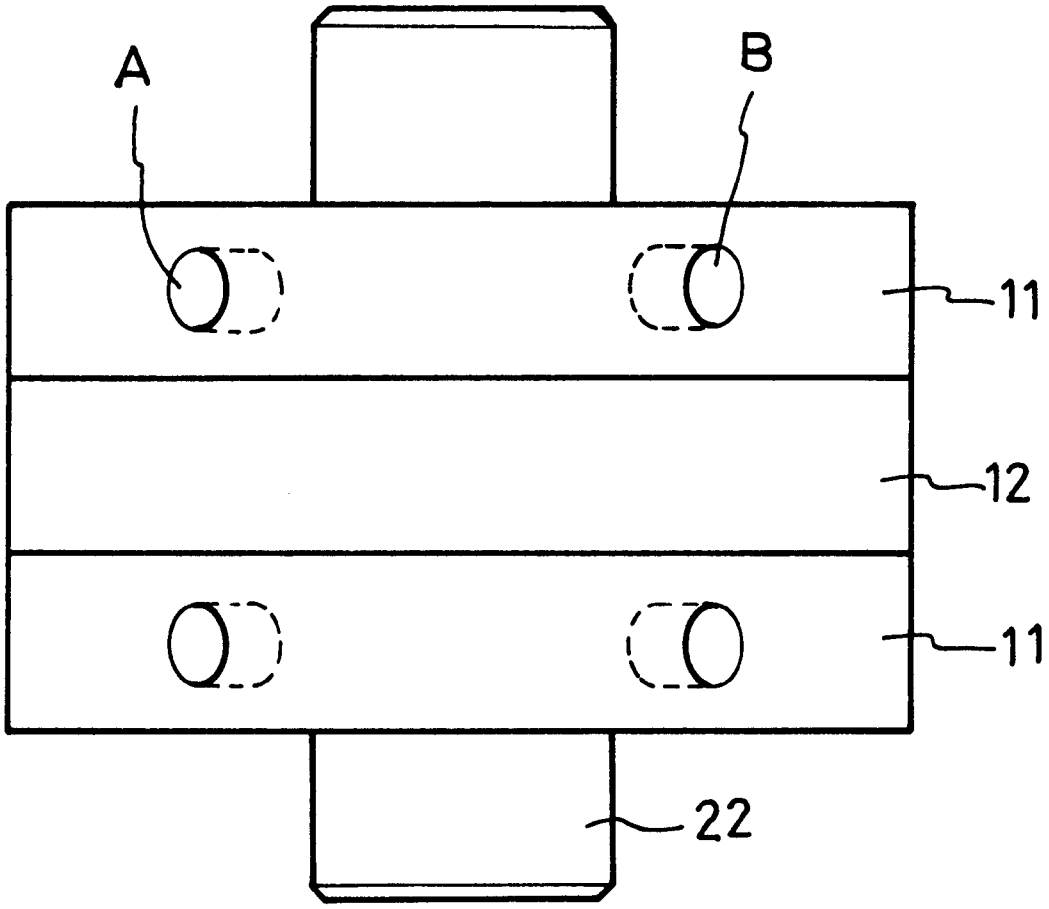
FIG. 4 is a plan view of the assembled device according to the invention.

Referring to FIGS. 2 and 3, the assembling and operation of the rotational power-generating device is respectively shown. In assembling, the blade 23 of the rotor assembly 2 is inserted and received within the retaining slot 213. Then the rotational shafts 22 are rotationally disposed within the mounting holes 113 of the cylinder casings 11 respectively. In this case, the collars 212 are closely contacted with the wall section 1111. Afterward, the cylinder ring 12 and two cylinder casings 11 are engaged firmly with each other by the engagement between the retaining holes 114 and the retaining pins 121. After the cylinder casings 11 and the cylinder ring 12 are firmly engaged with each other, the cylinder ring 12 is closely engaged with the neck portion 211 of the rotor 21.

In operation, since the mounting holes 113 are eccentrically disposed, the internal space of the cylinder block is divided into three closed areas. The rotational movement of the blade 23 can attain multiple functions.

In actual practice, the perimeter of the blade 23 can be provided with grooves, resilient compression rings, and oil control rings. During the compressing stroke, not only will blade 23 prevent oil leakage, but will also wipe off the excess oil. Besides, the retaining groove 213 and the blade 23 can also be disposed with flexible loops to prevent oil leakage. The other parts can be made from ductile material that provides excellent wear-proof capability as well as durability. On the other hand, the cylinder wall can be also provided with leakage-proof seals which are wear resistant, heat-resistant, and high-pressure resistant and are disposed at both sides of the neck portion 213 of the rotor 21.

By the provision of the present invention, the compression ratio can be considerably increased and mechanical efficacy is also increased. On the other hand, the rotational power-generating device features a simplified configuration which is quite durable.

While a particular embodiment of the present invention has been illustrated, it will be obvious to those skilled in the art that various other changes and modifications can be made without departing from the spirit and scope of the invention. It is therefore intended to cover in the appended claims all such changes and modifications that are within the scope of the present invention.

I claim:

1. A rotational power generating device comprising:

a) a cylinder block including a pair of cylindrical casings and a cylindrical ring secured between the casings to define an internal chamber;

b) each cylindrical casing including a circular side wall having an eccentric mounting hole, a cylindrical internal wall having a recessed arcuate wall section, and a circular front wall having a plurality of spaced retaining holes;

c) the cylindrical ring including a cylindrical internal wall, a pair of opposed circular faces, each circular face having a plurality of retaining pins extending therefrom, the pins being engaged within the retaining holes of the cylindrical casings for securing the front walls of the casings to the circular faces of the ring; and d) a rotor assembly including a cylindrical rotor, a pair of shafts extending from opposite sides of the rotor, the rotor including a pair of spaced collars defining a reduced neck portion therebetween, the neck portion being disposed in engagement with the cylindrical internal wall of the ring, the collars being disposed within the recessed arcuate wall sections of the casings, a longitudinal retaining slot extending through the neck portion and collars, a rectangular blade slidably retained within the slot for dividing the internal chamber into three closed areas, and the shafts extending outwardly of the casings through the mounting holes.

* * * * *